United States Patent [19]

Hrubesh

[11] 4,441,532

[45] Apr. 10, 1984

[54] APPARATUS AND METHOD FOR GENERATING SINGLE DROPLETS

[75] Inventor: Charles F. Hrubesh, Fallston, Md.

[73] Assignee: The United States of America as represented by the Secretary of the Army, Washington, D.C.

[21] Appl. No.: 373,939

[22] Filed: May 3, 1982

[51] Int. Cl.[3] ..... B65B 3/04

[52] U.S. Cl. ..... 141/1; 141/98; 222/154; 222/420; 422/99

[58] Field of Search ..... 222/420, 421, 422, 154; 141/250–284, 98, 392, 1, 94, 2–12, 18–27, 83; 422/63, 64, 65, 100, 99

[56] References Cited

U.S. PATENT DOCUMENTS

| | | | |
|---|---|---|---|
| 3,572,400 | 3/1971 | Casner et al. | 222/420 |
| 3,677,447 | 7/1972 | Renty | 222/420 |
| 3,810,779 | 5/1974 | Pickett et al. | 222/420 |
| 4,030,640 | 6/1977 | Citrin et al. | 222/420 |
| 4,041,995 | 8/1977 | Columbus | 222/420 |

*Primary Examiner*—Houston S. Bell, Jr.

*Attorney, Agent, or Firm*—Robert P. Gibson; Anthony T. Lane; Michael C. Sachs

[57] ABSTRACT

Apparatus and method are described for generating single droplets of fluid material in the 40 to 1100 micrometer range. A generator needle assembly is provided having a wire selected for insertion in the needle with critical push-fit clearance and a tapered ground pointed end having an acute included angle of less than 15 degrees. The plunger of the syringe is mechanically advanced while telescopically observing the droplet size. A pneumatic collet is used which air strips the droplet without turbulence to produce uniform sized single droplets without the inclusion of satellite droplets.

7 Claims, 3 Drawing Figures

APPARATUS AND METHOD FOR GENERATING SINGLE DROPLETS

GOVERNMENTAL INTEREST

The invention described herein may be manufactured, used and licensed by or for the Government for governmental purposes without the payment to me of any royalty thereon.

BACKGROUND OF THE INVENTION

The present invention relates to an apparatus and method for producing a single droplet of known size. The present device permits highly toxic liquids to be dispensed one droplet at a time in sizes ranging in controlled predictable diameters from 50 to 1100 micrometers.

Various means have been used in the prior art to evaluate various sensor configurations for use in the detection of hazardous liquid chemical agents. The problem with prior art single droplet generators which utilized air stripping was the generation of "satellite" droplets when the droplet hit the desired impact area. In addition, prior art devices using air stripping techniques frequently caused sufficient turbulence about the generator as to give the droplet a spin. The spinning droplet generally results in the droplet rolling after impacting its target and not remaining in a desired impact area.

SUMMARY OF THE INVENTION

The present invention relates to an apparatus and method for generating single droplets of fluid material having a diameter which can be selectively produced to range in diameter from 40 to 1100 micrometers. Single droplets are air stripped from a generator without significant spin to impact within a 2 mm radius target area. One of the most important features of this apparatus for single droplet generation is the complete elimination of "satellite" droplets. This means that the single droplets do not break up and that their point of impact is predictable to within a very small area.

An object of the present invention is to provide a single droplet generator wherein all of the droplets stripped by the same air velocity are of uniform size.

Another object of the present invention is to provide a single droplet generator wherein the droplet size may be accurately varied from 40 to 1100 micrometer diameter size.

Another object of the present invention is to provide a single droplet generator for highly toxic liquids having dispensing means which is completely controllable.

A further object of the present invention is to provide a single droplet generator with complete elimination of "satellite" droplets.

For a better understanding of the present invention, together with other and further objects thereof, reference is made to the following descriptions taken in connection with the accompanying drawings.

BRIEF DESCRIPTION OF THE DRAWINGS

Throughout the following description, like reference numerals are used to denote like parts of the drawings.

DESCRIPTION OF THE PREFERRED EMBODIMENTS

Figure 1:
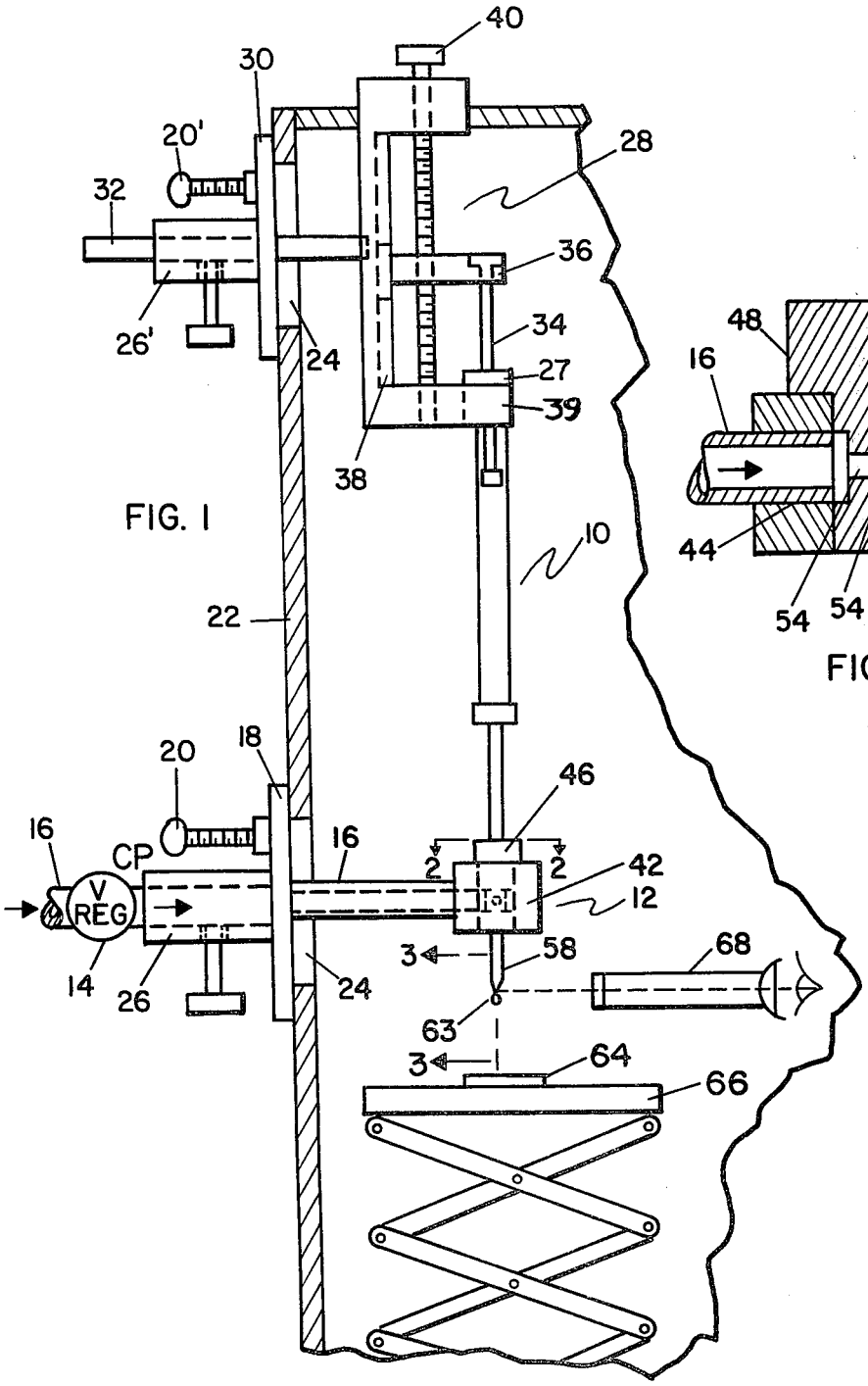
FIG. 1 is a partial cutaway view of the single droplet generator.

Referring now to FIG. 1, clean, dry, filtered air is passed around a specially constructed hypodermic needle assembly 10 by means of an air collet assembly 12. The air through collet assembly 12 is supplied with variable constant pressure regulated air by valve 14 via pneumatic conduit 16. The air supply conduit 16 and collet assembly are adjustably supported in the vertical direction by plate member 18. Plate 18 is fixedly held by thumb screw 20 to a vertical support wall 22. Horizontal positioning of the collet assembly 12 through vertical slot 24 is maintained by adjustment of sleeve 26 on air supply line 16. The hypodermic needle assembly 10 is removably supported at its upper end 27 by syringe drive assembly 28. Syringe drive assembly is operatively vertically aligned by a second plate member 30 which is fixed to vertical support wall 22 by thumb screw 20[1] in a similar fashion to first plate member 18. Support rod 32 is fixedly attached to drive member 34 and horizontally adjusted by horizontal adjustment sleeve 26' in a similar fashion to aforedescribed air supply line 16. Syringe plunger 34 is fixedly held by the horizontal sliding bar plunger holder 36. Holder 36 which slides in a "T" shaped groove 38 can be moved vertically up and down by the threaded adjustment screw 40. The lower end 39 of "C" shaped element fixedly holds the hypodermic needle assembly in a fixed vertical position.

Figure 2:
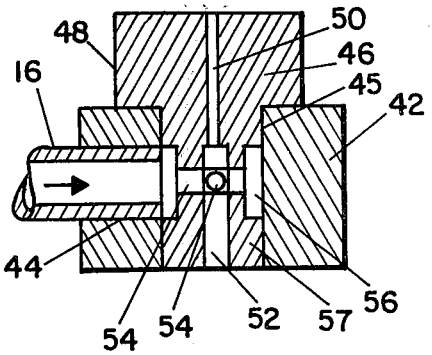
FIG. 2 is an enlarged diametral cross-sectional view of the air collet taken through line 2—2 of FIG. 1.

Referring now to FIG. 2, air line 16 is pneumatically connected to collet holder 42 via side bore 44. A "T" shaped collet is fixedly located in collet holder axial bore 45. Collet 46 is made of such material as teflon, and has an upper section 48 which has a small central collet bore 50 which communicates with a larger axially aligned collet bore 52 and a plurality of horizontal bores 54 and 54[1] which in turn communicate with annular air distribution groove 56, all located in the collet lower section 57.

Figure 3:
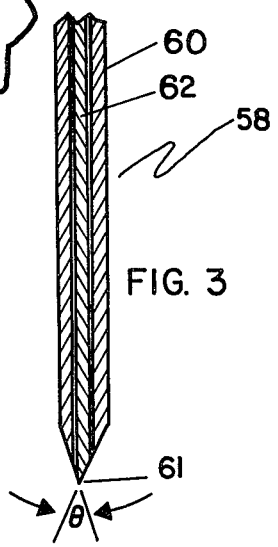
FIG. 3 is an enlarged longitudinal cross-sectional view of the needle generator taken through line 3—3 of FIG. 1.

Referring now to FIGS. 1-3, a droplet generator 58 comprises a hypodermic needle 60 of known bore and a stainless steel inner wire member 62 of slightly smaller diameter such as to provide a hard finger push-fit between the bore of needle 60 and the outer diameter of wire 62. Critical to the success of the generator is the closeness of this fit. The wire-needle assembly of FIG. 3 is then ground to a very sharp point. The included angle $\theta$ of the point should be approximately 15 degrees.

In operation the preparation of the droplet needle generator 58 is accomplished by inserting the assembly 58 into the collet of a jewelers' lathe and running the lathe at 1000 rpm. The point is then ground with a high-speed grinder rotating in a direction opposite from the assembly and at a speed of 20,000 rpm. The taper and point must be made concentric with the longitudinal axis of the generator needle 58. Generator needle assembly 58 is inserted through collet bores 50 and 52. In collet bore 50, there is a "snug" fit between the generator 58 and the bore 50 to prevent the escape of air in the wrong direction. This "snug" fit serves two purposes; firstly, the generator 58 is held rigidly, and secondly, it is held concentric within the larger lower bore 52. Near the junction of the two concentric bores, four equally spaced bores 54 allow air to enter the larger bore 52 and to flow down the periphery of generator 58 with a minimum of turbulence. This low air turbulence is critical to the operation since it allows a droplet 63 to be directed to its point of impact on a coated glass microscope slide 64, held by adjustable table 66, without excessive deviation from the vertical axis of the generator 58 and to stay within a 2 mm radius of the desired impact point.

The airflow velocity through regulator 14 controls the size of the liquid droplets produced. In general, the greater the velocity, the smaller are the droplets produced. The liquid to be dropped is fed to the generator 58 from needle assembly 10 by advancing syringe plunger 36 by rotation of plunger screw 40. The rate of advance is governed by watching the formation of droplet 63 at the tip 61 of generator 58 through a short focus telescope 68. When the droplet reaches a predetermined size, it is air stripped from the generator 58. The size of the single droplets produced by this method can be calibrated by impacting them on a magnesium oxide coated slide, then examining the slide on the stage of a 100 power microscope, not shown, having a measuring reticle attached to the microscope eyepiece. The actuatl droplet size is determined by multiplying the crater diameter formed by a constant conversion factor. This invention permits controlled single droplets to be produced ranging in diameter from 40 to 1100 micrometers wherein all the droplets generated at predetermined airflow rate are all of uniform size.

While there has been described and illustrated specific embodiments of the invention, it will be obvious that various changes, modifications and additions can be made herein without departing from the field of the invention which should be limited only by the scope of the appended claims.

What is claimed is:

1. A method for generating single droplets which includes the steps of selecting the diameter of a stainless steel wire so that it can be hard finger push-fit into a hypodermic needle of known bore to form a generator needle assembly;

grinding the generator needle tip to a point having an included angle of approximately 15 degrees;

assembling the ground generator needle to a hypodermic syringe;

filling the syringe with a liquid to be dispensed from said generator needle;

inserting the plunger of said hypodermic syringe into support means which provides adjustable horizontal support and calibrated adjustable vertical motion to the plunger;

inserting the generator needle assembly into a pneumatic collet which allows regulated air to flow down the periphery of the generator needle with a minimum of turbulence;

preparing a microscope slide with a coating of magnesium oxide;

positioning the microscope slide so that it is in axial alignment with the longitudinal axis of the generator needle;

adjusting a short focus telescope to be in optical alignment with the pointed end of the generator needle;

advancing the plunger of the syringe while observing the droplet formation at the tip of the generator;

adjusting a constant pressure flow regulator to deliver a desired flow rate to air strip the droplet from the generator;

collecting the droplet on the microscope slide; and calculating the diameter of the droplet after observing the droplet diameter on the microscope slide.

2. The method of claim 1 wherein the method of generating droplets further includes a step of choosing a hypodermic needle of a bore size compatible with generating droplets of diameter within the range of 40–1100 micrometers.

3. The method of claim 1 wherein the step of inserting the plunger includes the further step of providing support means which includes:

a vertical wall having a first and second vertical slot therein;

a first plate member fixedly attached to said vertical wall;

a horizontal support rod slidable adjustably disposed in said first plate member and through said first slot; and syringe drive assembly means for holding and regulating the vertical position of the syringe plunger of said hypodermic needle assembly.

4. The method of claim 3 wherein the step of providing support means further comprises the step of providing a syringe drive assembly means which includes:

a "C" shaped member fixedly attached to said support rod;

a "T" shaped groove disposed in the vertical leg of said "C" shaped member; and a sliding bar member operatively located in said "T" shaped groove and fixedly holding said syringe plunger; and a threaded adjustment screw operatively engaging said sliding bar member for accurately controlling the vertical movement of said sliding bar member.

5. The method of claim 3 wherein the step of providing a support means includes providing:

a second plate member fixedly attached to said vertical wall, said second plate member; and a pneumatic pressure regulated supply air line slidably and adjustably fixed in said second plate member and protruding through said second vertical slot.

6. The method of claim 1 including providing for the pneumatic collet a pneumatic supply means includes a constant pressure regulator valve operatively disposed in said pneumatic air line.

7. The method of claim 6 including further providing for the pneumatic collet:

a collet holder pneumatically connected to said pressure regulated pneumatic air supply line via a side bore, and having an axial bore operatively disposed therein; and a "T" shaped collet member fixedly located in said axial bore of said collet holder which includes:

an upper section having a central collet bore disposed therein;

a lower section having an axially aligned collet bore having a diameter larger than said central bore of said upper section, an annular distribution groove which communicates with said pneumatic air supply line, and a plurality of horizontal bores which pneumatically communicate with said distribution groove and said axially aligned collet bore.

* * * * *